US008294615B2

(12) United States Patent
Caille et al.

(10) Patent No.: US 8,294,615 B2
(45) Date of Patent: Oct. 23, 2012

(54) ARRAY ANTENNA WITH IRREGULAR MESH AND POSSIBLE COLD REDUNDANCY

(75) Inventors: Gérard Caille, Tournefeuille (FR); Philippe Voisin, Toulouse (FR); Yann Cailloce, Toulouse (FR); Cécile Guiraud, Goyrans (FR)

(73) Assignee: Thales (FR)

( * ) Notice: Subject to any disclaimer, the term of this patent is extended or adjusted under 35 U.S.C. 154(b) by 210 days.

(21) Appl. No.: 12/095,211

(22) PCT Filed: Nov. 27, 2006

(86) PCT No.: PCT/FR2006/051232

§ 371 (c)(1),
(2), (4) Date: Nov. 10, 2008

(87) PCT Pub. No.: WO2007/060375

PCT Pub. Date: May 31, 2007

(65) Prior Publication Data

US 2009/0303125 A1 Dec. 10, 2009

(30) Foreign Application Priority Data

Nov. 28, 2005 (FR) ..... 05 53623

(51) Int. Cl.
*H01Q 3/00* (2006.01)

(52) U.S. Cl. ..... 342/368

(58) Field of Classification Search ..... 342/368, 342/893, 836

See application file for complete search history.

(56) References Cited

U.S. PATENT DOCUMENTS

| | | | | | |
|---|---|---|---|---|---|
| 4,052,723 | A | | 10/1977 | Miller | |
| 4,101,892 | A | * | 7/1978 | Alford | 342/413 |
| 4,119,972 | A | * | 10/1978 | Fletcher et al. | 343/844 |
| 4,318,104 | A | * | 3/1982 | Enein | 342/372 |
| 5,497,164 | A | * | 3/1996 | Croq | 343/700 MS |
| 6,147,648 | A | * | 11/2000 | Granholm et al. | 343/700 MS |

(Continued)

FOREIGN PATENT DOCUMENTS

| | | |
|---|---|---|
| EP | 0474977 A2 | 3/1992 |
| GB | 2384914 | 8/2003 |

OTHER PUBLICATIONS

Eloy d Lera Acedo, "Low Costing Arrays of Differentially Fed TSA Elements", Nov. 26-30, 2007, SKADS MCCT Technical Workshop, Netherlands Foundation for Research in Astronomy.*

(Continued)

*Primary Examiner* — Jack W Keith
*Assistant Examiner* — Frank J McGue
(74) *Attorney, Agent, or Firm* — Lowe Hauptman Berner & Ham LLP

(57) ABSTRACT

A transmit and/or receive array antenna comprises an array (R) of sub-arrays (SR) of at least one radiating element (ER) and control means charged with controlling the amplitude and/or the phase of the radiofrequency signals to be transmitted or received in the form of waves by each of the sub-arrays (SR) so that they transmit or receive signals according to a chosen pattern. The sub-arrays (SR) comprise a mean number of radiating elements (ER) which increases from the center of the array (R) to its periphery, and are arranged with respect to one another so as to constitute an irregular mesh offering pattern sidelobes of low intensity and a high gain in a favored direction.

18 Claims, 3 Drawing Sheets

U.S. PATENT DOCUMENTS

| | | | | |
|---|---|---|---|---|
| 6,246,364 | B1 * | 6/2001 | Rao et al. | 342/368 |
| 6,288,673 | B1 * | 9/2001 | Dolmeta et al. | 342/374 |
| 6,366,254 | B1 * | 4/2002 | Sievenpiper et al. | 343/770 |
| 6,374,104 | B1 | 4/2002 | Croq et al. | |
| 6,456,244 | B1 * | 9/2002 | Goldstein et al. | 343/700 MS |
| 6,897,829 | B2 * | 5/2005 | Oliver et al. | 343/893 |
| 7,142,164 | B2 * | 11/2006 | Legay et al. | 343/754 |
| 7,714,782 | B2 * | 5/2010 | Davis et al. | 342/377 |
| 2002/0140616 | A1 | 10/2002 | Kanamaluru | |
| 2006/0164284 | A1 * | 7/2006 | Pauplis et al. | 342/16 |

OTHER PUBLICATIONS

Free Online Dictionary, definition of "redundancy", downloaded Feb. 23, 2012.*

* cited by examiner

ARRAY ANTENNA WITH IRREGULAR MESH AND POSSIBLE COLD REDUNDANCY

CROSS-REFERENCE TO RELATED APPLICATIONS

The present Application is based on International Application No. PCT/FR2006/051232, filed on Nov. 27, 2006, which in turn corresponds to French Application No. 0553623 filed on Nov. 28, 2005, and priority is hereby claimed under 35 USC §119 based on these applications. Each of these applications are hereby incorporated by reference in their entirety into the present application.

FIELD OF THE INVENTION

The invention relates to array antennas.

BACKGROUND OF THE INVENTION

Here, "array antenna" is understood to mean an antenna able to operate in transmission and/or reception and comprising an array of sub-arrays of at least one radiating element and control means suitable for controlling by means of active chain(s) the amplitude and/or the phase of the radiofrequency signals to be transmitted (or in the opposite direction, received from space in the form of waves) by each of the sub-arrays so that they transmit (or receive) radiofrequency signals according to a chosen pattern. Consequently, this will equally well involve so-called direct-radiation array antennas (often denoted by their acronym DRA), active or more rarely passive ones, and "reflector-array antennas" (or "reflectarray antennas").

As known by the person skilled in the art, certain array antennas, such as for example the direct-radiation antennas with amplifiers distributed just behind the radiating elements, make it possible to operate in multibeam mode, this being a basic property required for example within the framework of multimedia missions in the Ka band (18.2 GHz to 20.2 GHz in transmission or 27.5 GHz to 30 GHz in reception), or to reconfigure beams in flight, for example in the Ku band (10.7 GHz to 12.75 GHz in transmission or 13.75 GHz to 15.6 GHz in reception).

However, these arrays exhibit two main drawbacks. They in fact require a large number of active chains once the coverage zone has to be decomposed into very fine beams (or "spots") and there is a strong constraint of isolation between nearby zones so as to be able periodically to reuse one and the same frequency sub-band. Furthermore, the low energy efficiency (determining criterion in transmission) of the amplifiers included in their active chains in the presence of broadband multi-carriers gets worse when they are not used at their optimal power level. This results in fact from what is called apodization (also known as "taper") which is indispensable when one wishes to obtain fairly weak sidelobes (of the antenna patterns). It is recalled that apodization is a technique consisting in placing more energy at the center of the array than at its periphery.

A third drawback may be added to the previous two main ones when in the presence of a strong constraint of isolation between nearby zones on account of frequency reuse. Specifically, the "gentle" degradation in performance when a few active chains become faulty (progressively during a mission) often becomes unacceptable when the percentage of faults becomes significant. To remedy this drawback it is admittedly possible to envisage a conventional redundancy of sub-arrays of radiating elements, of the type "2 for 1", or "3 for 2", or else "10 for 8", but this entails unacceptable complexity for large arrays, and a significant increase in mass (particularly penalizing drawback for antennas aboard satellites).

To attempt to remedy the aforesaid drawbacks, there has been proposed in patent document FR 2762937 a sparse array antenna with "cold redundancy". This solution consists in providing at chosen locations of the array a restricted number of substitute sub-arrays and of associated active control chains, which are used only in the event of a fault with one or more active control chains. The locations of these substitute sub-arrays are chosen so that transmission and/or reception continues to meet the requirements: to a first approximation, the apodized distribution law for the energy must remain overall similar before and after activation of some of the redundancies.

When a substitute sub-array is not used, it forms a transmission and/or reception void in the array, which is taken into account during antenna optimization. However, the presence of a considerable number of voids in the array lowers the directivity of the antenna for a given exterior dimension. Additionally, because of the regular meshing of the array before the definition of the voids, if one wishes to obtain weak sidelobes (to prevent in particular the "array lobes" due to the periodicity from interfering in the useful angular domain) it is compulsory to use sub-arrays with a small number of radiating elements, so that the total number of sub-arrays can be only slightly reduced.

Since no known solution is entirely satisfactory, the aim of the invention is therefore to improve the situation.

SUMMARY OF THE INVENTION

It proposes for this purpose a transmit and/or receive array antenna comprising an array of sub-arrays of at least one radiating element and control means charged with controlling the amplitude and/or the phase of the radiofrequency signals to be transmitted or received in the form of waves by each of the sub-arrays so that they transmit or receive radiofrequency signals according to at least one chosen pattern.

This array antenna is characterized by the fact that its sub-arrays comprise a mean number of radiating elements which increases from the center of the array to its periphery, and are arranged with respect to one another so as to constitute an irregular mesh offering pattern sidelobes of low intensity and a high gain in a favored direction.

The array antenna according to the invention can comprise other characteristics which can be taken separately or in combination, and notably:

- its sub-arrays can be arranged with respect to one another according to a distribution of constrained optimized pseudo-random type, for example using algorithms of "genetic" or "simulated annealing" type;
- its array can for example comprise a central part in which the sub-arrays comprise between one and four (and for example between one and two) radiating elements, and surrounded by a peripheral part where they preferably comprise between one and sixteen elements, with a much higher mean number than in the central part;
- the irregular mesh can be achieved on the basis of sub-arrays consisting of groups of at least two compact planar radiating elements;
- the irregular mesh is for example achieved on the basis of first, second and third sub-arrays consisting of groups comprising respectively four, eight and sixteen compact planar radiating elements;
- the compact planar radiating elements are for example small metal tiles (or "patches");

some sub-arrays, termed "substitute", installed at chosen locations, can be provided only to be used in the event of failure of at least one other sub-array. In this case, most of the substitute sub-arrays can for example be installed in a peripheral part of the array, precisely where the presence of "voids" in the illumination of the antenna is not penalizing (but contributes together with the irregular mesh to creating the necessary apodization);

it can take the form of a direct-radiation active antenna (commonly called a DRA). In this case, its control means comprise a "beam former" (its acronym being BFN), controllable or not, and signal amplifiers (or active chains) each associated with one of the sub-arrays (including those termed substitute, when they exist) and charged with operating according to substantially identical powers on transmission;

such a beam former, coupled to the active chains, is in particular indispensable for allowing the transmission and/or reception of at least two radiofrequency signal beams in chosen directions;

the beam-forming means can be reconfigurable so as to allow the modification of the chosen directions of the beams and/or the number of beams;

in a variant, it can take the form of a reflector array antenna. In this case, there is(are) no beam former(s) in circuit form. The distributing of the signal in transmission (or its summation in reception) is performed in free space from (or to) a primary source, and the shape and orientation of the beam are controllable by virtue of devices integrated into the radiating elements.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious aspects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

The appended drawings will be able not only to serve to supplement the invention, but also contribute to its definition, as appropriate.

DETAILED DESCRIPTION OF THE PREFERRED EMBODIMENTS

The object of the invention is notably to allow a reduction in the number of sub-arrays of an array antenna, apodization by means of amplifiers of substantially identical powers (in the best adapted case of a transmission antenna), as well as possible redundancy to alleviate faults.

In what follows, it is considered by way of nonlimiting example that the array antenna is of direct radiation (or DRA) type. But the invention is not limited to this type of array. It relates also to reflector array antennas.

It is recalled that a reflector array antenna consists of radiating elements charged with intercepting, with minimum losses, waves comprising radiofrequency signals to be transmitted, delivered by a primary source, so as to reflect them in a chosen direction, called the pointing direction. In order to allow reconfigurability of the antenna pattern, each radiating element is equipped with a phase control device with which it constitutes a passive or active phase-shifting cell.

To simplify the description, in what follows it is considered that the array antenna is dedicated to the transmission of radiofrequency signals. But the invention is not limited to this case. It in fact relates to array antennas dedicated to the transmission and/or reception of radiofrequency signals.

Figure 1:
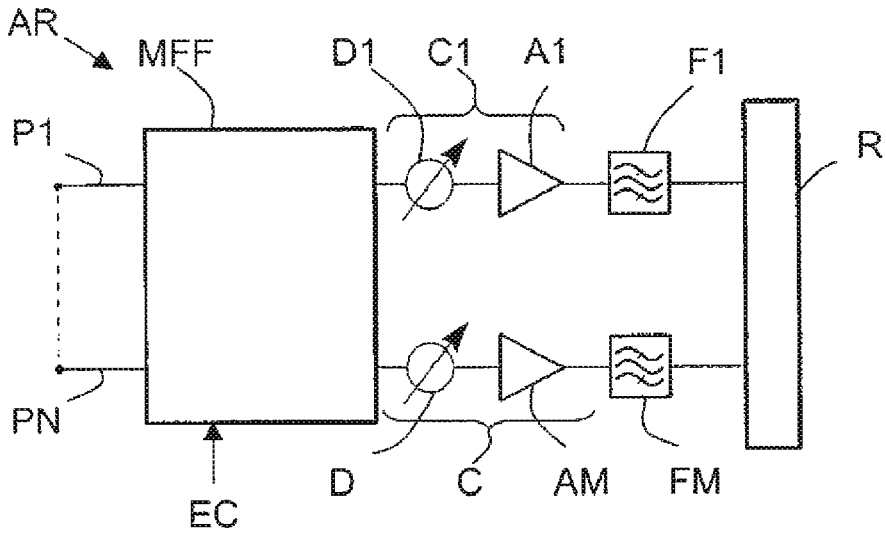
FIG. 1 illustrates in a very diagrammatic and functional manner an exemplary embodiment of a direct-radiation array antenna to which the invention can apply.

Reference is first made to FIG. 1 to describe a direct-radiation array antenna AR capable of implementing the invention.

As is schematically and functionally illustrated in FIG. 1, a direct-radiation array antenna AR comprises an array R of M (M>1) sub-arrays of at least one radiating element (not represented), M active chains Cm (m=2 to M) each coupled to one of the M sub-arrays, possibly by way of a filter Fm, for example of bandpass type, and a beam-forming module (or array) MFF (or BFN for "Beam Forming Network") comprising N input ports Pn (n=1 to N, N>0) and M output ports each coupled to the input of an active chain Cm.

All the radiating elements of an array (or panel of radiating elements) R are generally of the same type. They are for example tiles (or "patches"), horns, dipoles, or helixes. Tiles (or patches), which are compact but highly non-directional elements, are preferably used as sub-arrays, that is to say as subsets (that are more directional) consisting of several patches linked by fixed lines, as is the case in FIG. 5, to which we shall return further on. They therefore lend themselves particularly well to a variable arrangement with fine granularity (without excessive cost), this being one of the objectives of the present invention.

Each active chain Cm comprises for example a phase shifter Dm, charged with applying a chosen phase shift to the signals that the associated sub-array must transmit in the form of waves, and a power amplifier Am, charged with applying a chosen amplification to the phase-shifted signals having to be transmitted by the radiating elements concerned in the form of waves (or electromagnetic radiation).

The amplifiers Am are usually of so-called SSPA type ("Solid State Power Amplifier" delivering a power of a few Watts). More rarely, if the power to be provided exceeds some ten Watts, and if low consumption is predominant with respect to the increase in the mass, the amplifiers can be "mini-tubes" (compact version of "Traveling Wave Tubes (or TWT)" used for a long time in the field of radars and satellite communication systems).

The beam-forming module MFF can be either of analog type, or of digital type. It is charged with supplying the various active chains Cm with signals to be phase shifted (so as to simultaneously re-point all the beams, in the event of spurious movement of the carrier of the array antenna), and to be amplified (as well as possibly to be filtered). In cases where it is desired that the directions of each of the beams be independently controllable, the controllable phase shifters, represented in FIG. 1, are also included in the beam-forming module MFF: there are then as many of them as beams and radiating elements.

The whole set of phases and amplification levels which must be applied to the signals by the various active chains Cm is called a phase and/or amplitude law. This law defines a pattern (here a transmission pattern) for the AR antenna. The number of different patterns that an AR antenna can simultaneously generate depends on the number of input ports Pn of the beam-forming module MFF. Each input port Pn is in fact charged with activating a given pattern. Each (transmission) pattern corresponds to the transmission of a beam of waves in a given direction so as to cover a zone (or spot).

It is important to note that an AR antenna can simultaneously transmit several beams corresponding to different patterns activated by different input ports Pn (one then speaks of multibeam operation). Additionally, when the programming of the patterns is frozen in the beam-forming module MFF, the antenna is termed a "fixed beam antenna", often called a "passive antenna". In the converse case, the antenna is termed reconfigurable, often called an "active antenna", since the presence of controllable elements is almost always associated with that of amplifiers distributed over all the pathways. It then comprises, as illustrated in FIG. 1, a configuration input EC (that is to say a wire connection with a preprogrammed control module).

It will additionally be noted that an array antenna dedicated to reception exhibits an arrangement similar to that of the array antenna dedicated to transmission presented above. What differentiates them is the fact that the energy is transmitted in the opposite direction (from the radiating elements to the beam-forming module) by way of low noise amplifiers (LNAs).

The invention pertains to the particular arrangement of the array R of sub-arrays SR of radiating elements ER.

Figure 2:
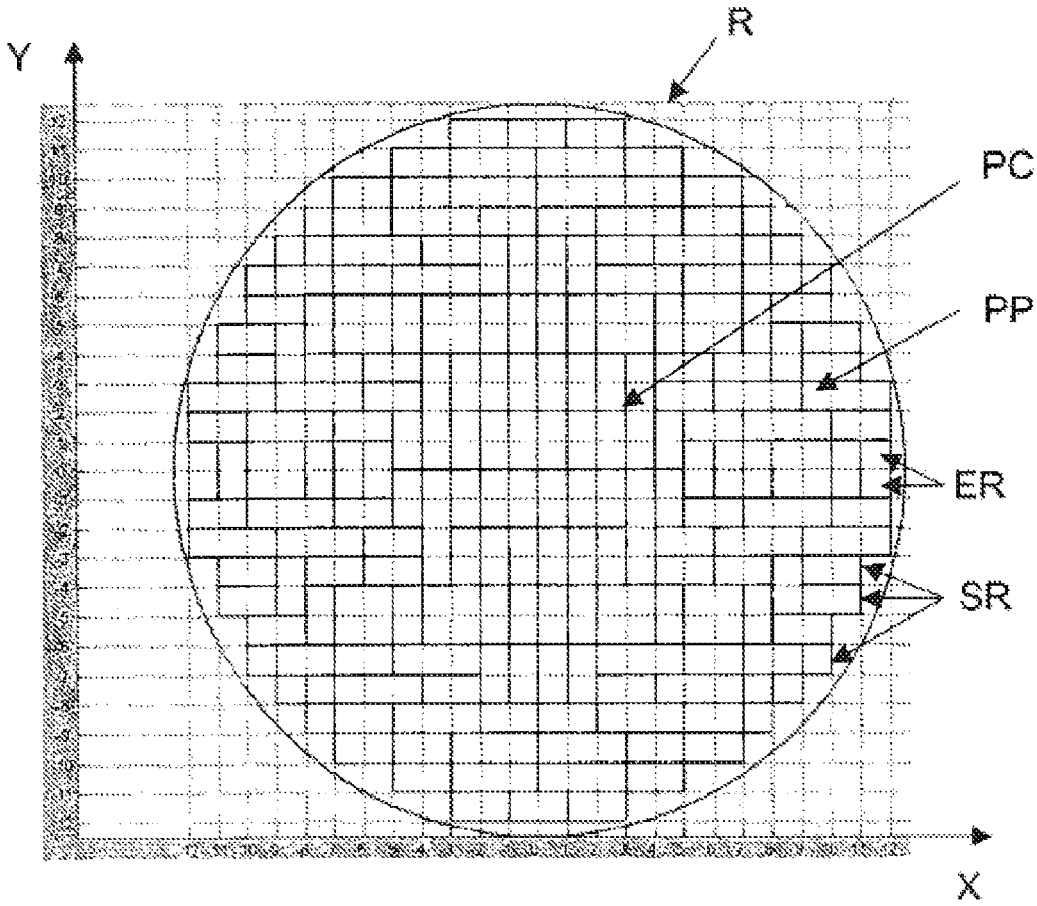
FIG. 2 illustrates in a very diagrammatic manner a first exemplary array with irregular mesh according to the invention, in an intermediate optimization phase.
Figure 3:
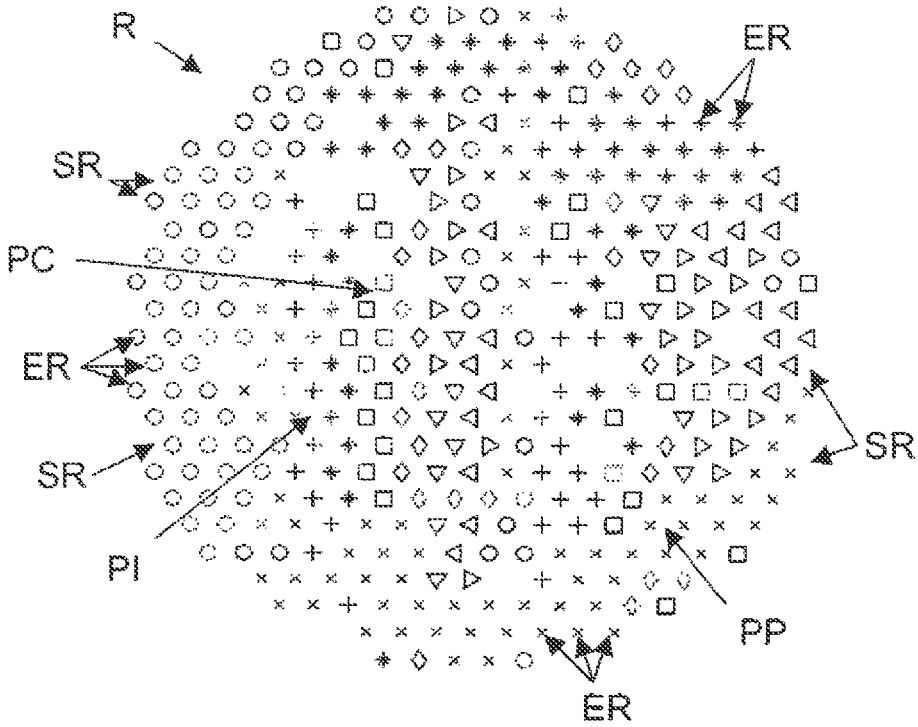
FIG. 3 illustrates in a very diagrammatic manner a second exemplary array with irregular mesh according to the invention.
Figure 4:
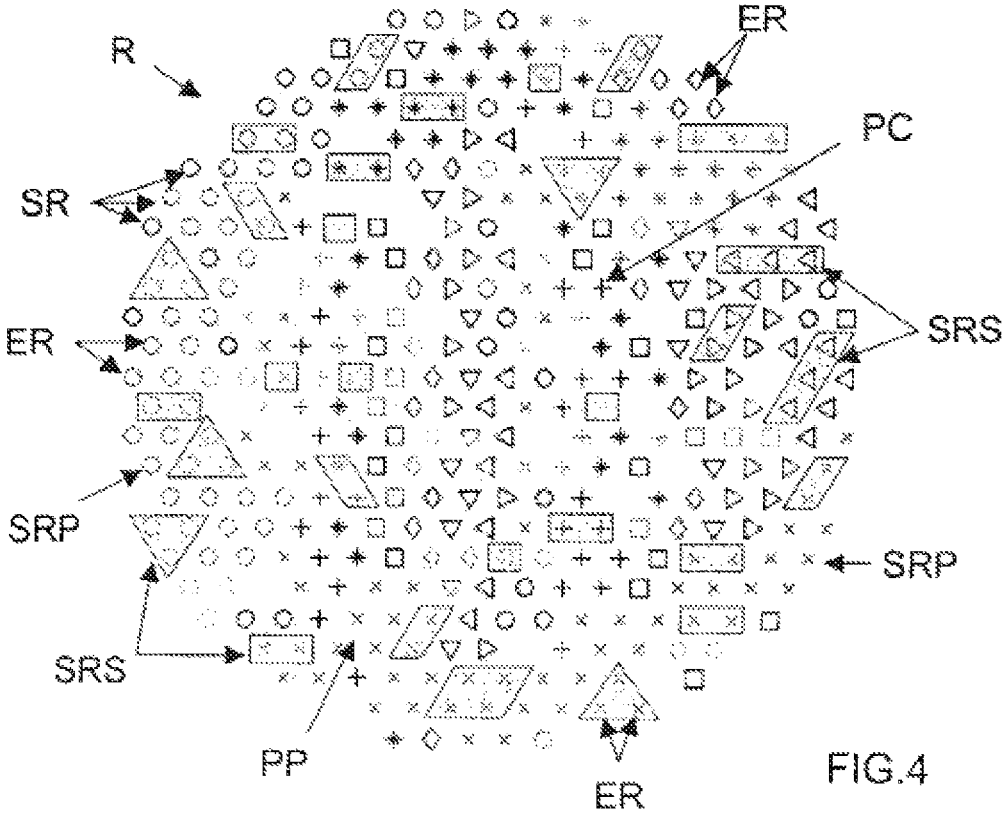
FIG. 4 illustrates in a very diagrammatic manner a third exemplary array with irregular mesh and cold redundancy according to the invention.

More precisely, according to the invention and as illustrated in the three nonlimiting examples of FIGS. 2 to 4, the sub-arrays SR of the array R, on the one hand comprise a mean number of radiating elements ER which increases from the center PC of the array R to its periphery PP (except in the case of FIG. 2, which illustrates an intermediate configuration that does not take into account the entirety of the criteria), and on the other hand are arranged with respect to one another so as to constitute an irregular mesh.

Here, "mean number of radiating elements ER" is understood to connote a mean number with respect to a set of sub-arrays SR situated in one and the same region of the array R (for example a central part PC or a peripheral part PP). It does not therefore necessarily involve having, in one and the same region of the array R, sub-arrays SR with a systematically smaller number of radiating elements ER than that of the sub-arrays SR situated in another region of the array R, further away from its center. However, this is often the case. Thus, it is possible for example to envisage that the array R comprises a central part PC in which the sub-arrays SR comprise between one and three radiating elements ER, or indeed even between one and two radiating elements ER, and a peripheral part PP surrounding the central part PC and in which the sub-arrays SR comprise between one and fourteen radiating elements ER, or else between three and fourteen elements.

It is important to emphasize the fact that the mean growth in the number of elements from the center to the periphery, or stated otherwise the decrease in the density of the power supply points from the center to the periphery, makes it possible to obtain an apodization with amplifiers of the same power.

Specifically, the variation in the mean number of radiating elements ER from the center PC to the periphery PP makes it possible to obtain an apodization of the illumination with a minimum spatial variation in the power of the power amplifiers Am coupled to each sub-array SR. This makes it possible to use power amplifiers Am operating with substantially equal powers ("equi-power") at +/−1 dB at three standard deviations (3*o*), for example. These power amplifiers Am are thus optimized to obtain the best possible energy efficiency, while avoiding the expensive case of using several types of amplifiers with different powers.

An irregular mesh, by means of sub-arrays SR with different numbers of radiating elements ER and/or different shapes, makes it possible to obtain patterns whose sidelobes are of low intensity as well as a high gain in a favored direction (since very many voids in the array are avoided). The more irregular the mesh, the weaker the "array lobes". These "array lobes" are in fact the highest sidelobes, due to the periodicity of the mesh of a conventional array.

This irregular mesh results for example from a distribution of the sub-arrays SR of constrained pseudo-random type. It is determined as a function of the specifications on the sidelobes of the antenna, of the isolation between nearby zones in the case of frequency reuse, and of the constraint or constraints on the shape of the sub-arrays. Numerous types of constraint can be envisaged, such as for example the shape or shapes of the sub-arrays (sub-arrays of rectangular contour are easier to make for example with small horns or radiating tiles), or the decomposition of the array into symmetric quadrants.

The determination of the mesh is done by means of a specialized algorithm, such as for example a genetic algorithm (based on successive random draws organized in a judicious manner), a so-called "simulated annealing" algorithm, or any other type of algorithm known to specialists in the optimization of problems with discrete variables.

In FIG. 2 is illustrated a first exemplary array R with irregular mesh according to the invention, in an intermediate optimization phase (that is to say before considering the geometry-based apodization criterion). In this first example, each sub-array SR is delimited by continuous lines, while the radiating elements ER of a sub-array SR are separated by dots.

For example, if the X (abscissa) and Y (ordinate) axes of the reference frame are referred to:

- between the ordinates −12 and −11 (peripheral part PP) and between the abscissae −3 and +3 there are three sub-arrays SR of rectangular shape each comprising two radiating elements ER,
- between the ordinates −11 and −10 (peripheral part PP) and between the abscissae −5 and +5 there are two sub-arrays SR each comprising two radiating elements ER and two sub-arrays SR each comprising four radiating elements ER,
- between the abscissae −2 and +2 there are four columns which extend between the ordinates −8 and +8, each column comprising eight rectangular sub-arrays SR of two radiating elements ER. This is a zone situated in the central part PC of the array R,
- between the abscissae −4 and −2 and the ordinates −6 and −4 there is a square sub-array SR of four radiating elements ER.

This example corresponds to a situation mentioned above, in which the central part PC essentially comprises sub-arrays SR whose mean number of radiating elements ER is equal to two and is less than that (equal to about three) of the sub-arrays SR situated in the peripheral part PP, which also comprises sub-arrays SR with small numbers of radiating elements (two, or indeed just one).

In FIG. 3 is illustrated a second exemplary array R with irregular mesh according to the invention. In this second example, all the adjacent identical symbols define radiating elements ER of one and the same sub-array SR, connected to an active chain Cm.

This example corresponds more clearly to the criterion mentioned above, in which the central part PC comprises sub-arrays SR whose number of radiating elements ER lies between one and two, then the intermediate part PI comprises sub-arrays SR whose number of radiating elements ER lies between one and three, and the peripheral part PP comprises sub-arrays SR whose number of radiating elements ER lies between one and fourteen. There are therefore indeed sub-arrays SR for which the mean number of radiating elements ER increases markedly from the center to the periphery.

In FIG. 4 is illustrated a third exemplary array R having at one and the same time an irregular mesh and cold redundancies. In this third example, all the adjacent identical symbols define radiating elements of one and the same sub-array, connected to an active chain Cm. Each hatched zone represents a substitute sub-array SRS connected to an active chain Cm with so-called cold redundancy. The latter is described in detail in patent document FR 2762937. It will therefore not be described again here. It is simply recalled that an active chain Cm is said to have cold redundancy when it remains off (or unactivated) so long as it does not have to replace one or more other (non-redundant) active chains that have become faulty.

The use of active chains with cold redundancy simply requires that low-level switches be integrated into the beam-forming module MFF. Additionally, the cold redundancy active chains do not give rise to any over-consumption since they are energized only when they are used to replace at least one failed active chain (whose power supply is then cut off either by a specific command, or automatically in the event of fuse protection against short-circuits).

In the situation illustrated in FIG. 4, the array R therefore comprises substitute sub-arrays SRS and so-called main sub-arrays SRP (used when their respective active chains Cm are not faulty).

These substitute sub-arrays SRS are installed at locations that are chosen so that transmission and/or reception can continue to be done normally (that is to say with one or more almost unchanged patterns). The locations, shapes and numbers of radiating elements ER of the substitute sub-arrays SRS are preferably determined at the same time as those of the main sub-arrays SRP. Accordingly, an additional initial constraint consisting in providing transmission and/or reception voids is introduced into the calculation right from the start.

As is illustrated in FIG. 4, most of the substitute sub-arrays SRS can preferably be installed in the intermediate part PI and peripheral part PP of the array R. In this optional situation, the apodization is strong since there is no void in the central part; but compensation for the faults arising in the central part is not perfect. Consequently several options exist regarding the constraints that are placed on the locations of the substitute sub-arrays SRS, according to the relative weights allocated for the application considered to the various "quality criteria" of the array antenna to be designed.

Figure 5:
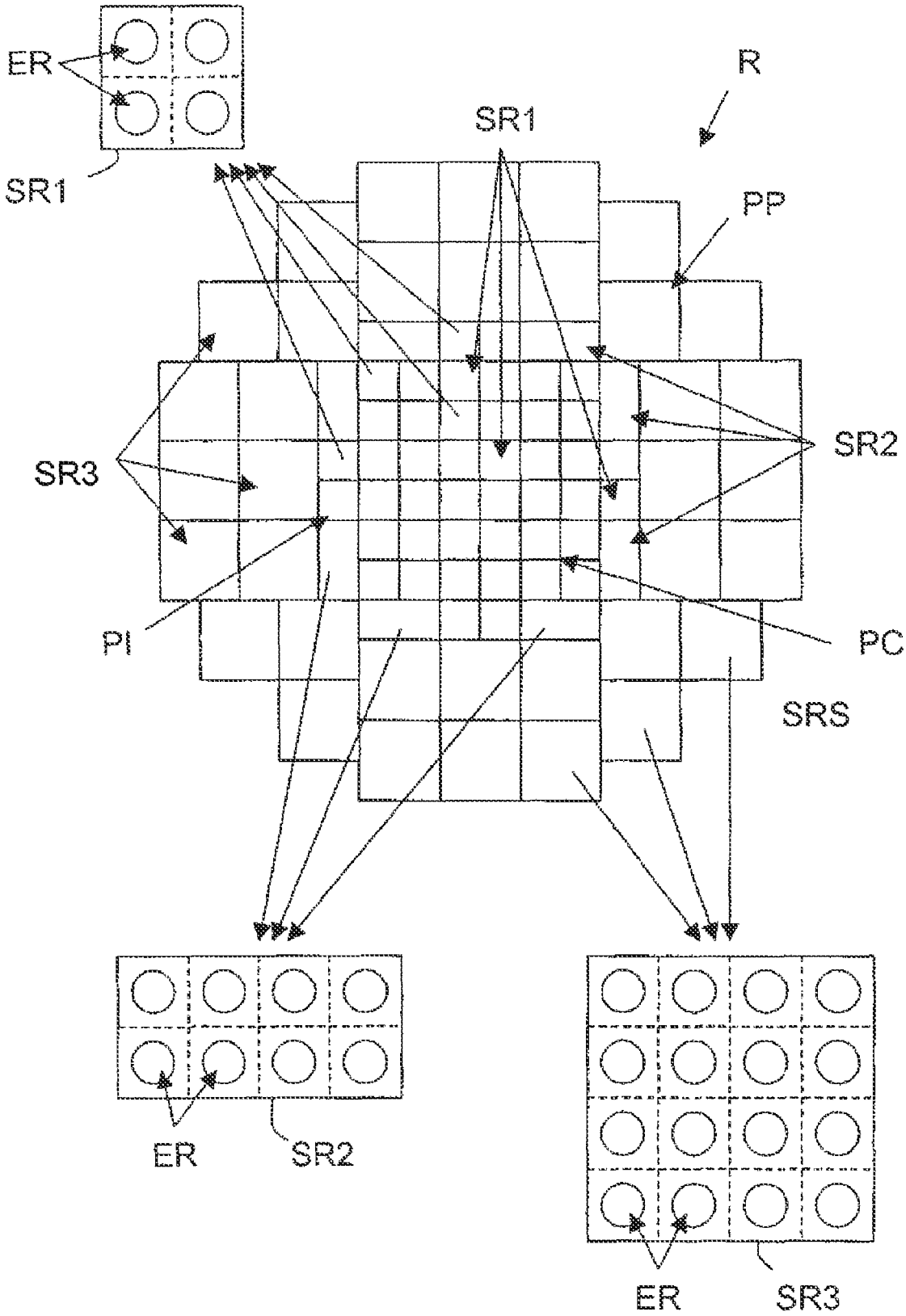
FIG. 5 illustrates in a very diagrammatic manner a fourth exemplary array with irregular mesh according to the invention.

In FIG. 5 is illustrated a fourth exemplary array R with irregular mesh according to the invention. This exemplary array is well suited to the array antennas on board satellites (for example in telecommunication applications).

In this fourth example, each geometric block (square or rectangular) represents a sub-array of at least two radiating elements ER of compact planar type, such as for example small metal tiles (or patches). More precisely, the irregular mesh is here constituted on the basis of three different sub-array types. Each first sub-array SR1 consists of a group of four compact planar radiating elements ER. Each second sub-array SR2 consists of a group of eight compact planar radiating elements ER. Each third sub-array SR3 consists of a group of sixteen compact planar radiating elements ER.

As in the other examples, the radiating elements ER of one and the same sub-array SR1, SR2 or SR3 are connected to an active chain Cm.

As is well known to the person skilled in the art, each sub-array can be constituted on the basis of a stack comprising for example a structure (made of aluminum for example) defining first cavities and the channels of the various excitation lines, then a circuit (made of duroid or of polyimide quartz for example) defining so-called "director" tiles which include the distribution lines, then a structure (made of aluminum for example) defining second cavities, then a circuit (made of duroid or of polyimide quartz for example) defining so-called "parasitic" tiles, and finally a radiation protection circuit.

As is illustrated, the first sub-arrays SR1 (which contain the lowest number of radiating elements ER) are placed in a central part PC of the array R, the second sub-arrays SR2 (which contain an intermediate number of radiating elements ER) are placed in an intermediate part PI of the array R, and the third sub-arrays SR3 (which contain the largest number of radiating elements ER) are placed in a peripheral part PP of the array R. There are indeed therefore sub-arrays SR for which the mean number of radiating elements ER increases markedly from the center to the periphery.

Of course, the number of compact planar radiating elements ER of the various sub-array types can be different from that illustrated. For example, it is possible to have first SR1, second SR2 and third SR3 sub-arrays comprising respectively 2, 4 and 8 compact planar radiating elements ER, or else 2, 8 and 16 compact planar radiating elements ER, or else 2, 8 and 32 compact planar radiating elements ER. Any other values can be envisaged.

Additionally, an irregular mesh can be defined on the basis of two sub-array types or indeed of more than three types.

By virtue of the invention, the number of active chains of the array antenna, and therefore its cost, can be appreciably reduced, compared with a conventional array antenna (that is to say regularly meshed) exhibiting substantially equivalent performance. This reduction can reach 50% in certain cases not using any cold redundancy active chain. The operation with cold redundancy requires the addition of about 10% of active chains with cold redundancy, so that the overall reduction becomes less than or equal to 40%. However, it makes it possible to preserve better performance for the array antenna in the presence of main active chain faults.

Additionally, the invention makes it possible to use amplifiers of substantially the same power, this again making it possible to reduce the cost of the array antenna and to improve its energy efficiency (it is in fact recalled that, in an array antenna with regular mesh, apodization requires very different powers).

The invention is not limited to the array antenna embodiments described above, merely by way of example, but it encompasses any variants that could be envisaged by the person skilled in the art within the framework of the claims hereinafter.

The invention claimed is:

1. A transmit and/or receive array antenna (AR) comprising:

an array (R) of sub-arrays (SR) of at least one radiating element (ER) and control means (Cm, MFF) suitable for controlling the amplitude and/or the phase of radiofrequency signals to be transmitted or received in the form of waves by each of said sub-arrays (SR) so that they transmit or receive signals according to at least one chosen radiating pattern, wherein said sub-arrays (SR) comprise a mean number of radiating elements (ER) which increases from a center of said array (R) to a periphery of the array (R), at least one of the sub-arrays (SR) having an asymmetrical shape and the sub-arrays (SR) are arranged with respect to one another in an arrangement constituting an irregular mesh offering pattern sidelobes of low intensity and a high gain in a favored direction, a portion of said sub-arrays (SRS), termed substitute and installed at chosen locations, are used only in the event of failure of at least one other portion of said sub-array (SRP), and the chosen locations are arranged so that the chosen radiating pattern is substantially unchanged, while amplifiers connected to each subarray all have the same gain and output power.

2. The array antenna as claimed in claim 1, wherein said sub-arrays (SR) are arranged with respect to one another according to a distribution of constrained optimized pseudo-random type.

3. The array antenna as claimed in claim 1, wherein said array (R) comprises a peripheral part (PP) surrounding a central part (PC) in which said sub-arrays (SR) comprise between one and four radiating elements (ER).

4. The array antenna as claimed in claim 3, wherein said central part (PC) comprises only sub-arrays (SR) comprising between one and two radiating elements (ER).

5. The antenna as claimed in claim 1, wherein said irregular mesh is achieved on the basis of sub-arrays consisting of groups of at least two compact planar radiating elements.

6. The array antenna as claimed in claim 5, wherein said irregular mesh is achieved on the basis of first sub-arrays consisting of groups of four compact planar radiating elements, of second sub-arrays consisting of groups of eight compact planar radiating elements, and of third sub-arrays consisting of groups of sixteen compact planar radiating elements.

7. The antenna as claimed in claim 5, wherein said compact planar radiating elements are small metal tiles.

8. The array antenna as claimed in claim 1, wherein most of said substitute sub-arrays (SRS) are installed at least in a peripheral part (PI) of said array (R).

9. The array antenna as claimed in claim 1, wherein the array antenna is of the type termed direct-radiation active antenna (DRA), and in that said control means (Cm, MFF) comprise active-control chains (Cm) each associated with one of said sub-arrays (SR) and arranged so as to operate according to substantially identical powers on transmission.

10. The array antenna as claimed in claim 9, wherein said control means (Cm, MFF) comprise beam-forming means (MFF), coupled to said active-control chains (Cm) so as to allow the transmission and/or reception of at least two radiofrequency signal beams in chosen directions.

11. The array antenna as claimed in claim 10, wherein said beam-forming means (MFF) are reconfigurable so as to allow the modification of said chosen directions of the beams and/or the number of beams.

12. The array antenna as claimed in claim 1, wherein the array antenna is of the type termed reflector array antenna.

13. The array antenna as claimed in claim 2, wherein the array antenna is of the type termed reflector array antenna.

14. The array antenna as claimed in claim 2, wherein the array antenna is of the type termed direct-radiation active antenna (DRA), and in that said control means (Cm, MFF) comprise active-control chains (Cm) each associated with one of said sub-arrays (SR) and arranged so as to operate according to substantially identical powers on transmission.

15. The antenna as claimed in claim 6, wherein said compact planar radiating elements are small metal tiles.

16. The array antenna as claimed in claim 2, wherein a portion of said sub-arrays (SRS), termed substitute and installed at chosen locations, are used only in the event of failure of at least one other sub-array (SRP).

17. The array antenna as claimed in claim 2, wherein said array (R) comprises a peripheral part (PP) surrounding a central part (PC) in which said sub-arrays (SR) comprise between one and four radiating elements (ER).

18. The antenna as claimed in claim 2, wherein said irregular mesh is achieved on the basis of sub-arrays consisting of groups of at least two compact planar radiating elements.

* * * * *